US009922476B2

(12) United States Patent
Masters et al.

(10) Patent No.: US 9,922,476 B2
(45) Date of Patent: Mar. 20, 2018

(54) LOCAL ACCESS CONTROL SYSTEM MANAGEMENT USING DOMAIN INFORMATION UPDATES

(71) Applicant: Schweitzer Engineering Laboratories, Inc., Pullman, WA (US)

(72) Inventors: George W. Masters, Moscow, ID (US); Colin Gordon, Pullman, WA (US)

(73) Assignee: Schweitzer Engineering Laboratories, Inc., Pullman, WA (US)

( * ) Notice: Subject to any disclaimer, the term of this patent is extended or adjusted under 35 U.S.C. 154(b) by 38 days.

(21) Appl. No.: 14/823,246

(22) Filed: Aug. 11, 2015

(65) Prior Publication Data

US 2017/0046892 A1 Feb. 16, 2017

(51) Int. Cl.
*G07C 9/00* (2006.01)

(52) U.S. Cl.
CPC ..... *G07C 9/00103* (2013.01); *G07C 9/00031* (2013.01); *G07C 9/00309* (2013.01); *G07C 9/00571* (2013.01); *G07C 2209/04* (2013.01)

(58) Field of Classification Search
USPC ..... 340/5.2, 5.21, 5.22, 5.6
See application file for complete search history.

(56) References Cited

U.S. PATENT DOCUMENTS 6,738,628 B1 5/2004 McCall
7,012,503 B2 3/2006 Nielsen
7,205,882 B2 4/2007 Libin
7,323,991 B1 * 1/2008 Eckert ..... G07C 9/00111 235/382
7,353,396 B2 4/2008 Micali
7,616,091 B2 11/2009 Libin
7,848,905 B2 12/2010 Troxler
8,108,914 B2 * 1/2012 Hernoud ..... G06F 21/32 713/185
8,407,775 B2 * 3/2013 Conlin ..... G07C 9/00007 340/5.61
8,446,249 B2 5/2013 Gerstenkorn
(Continued)

FOREIGN PATENT DOCUMENTS

WO 2010067205 6/2010
WO 2014029774 2/2014

OTHER PUBLICATIONS

PCT/US2015/038622 Patent Cooperation Treaty, International Search Report and Written Opinion of the International Searching Authority, dated Sep. 30, 2015.
(Continued)

*Primary Examiner* — Carlos E Garcia
(74) *Attorney, Agent, or Firm* — John P. Davis

(57) ABSTRACT

Systems and methods are presented for managing physical access to an access-controlled area using a local access control system. In certain embodiments, information that may be used in access control determinations managed by a remote domain controller may be communicated to a local access control system for use in connection with local access control determinations performed by the access control system independent of the domain controller. In some embodiments, such a configuration may allow for access control determinations to be performed when communication with the domain controller is interrupted and/or otherwise limited.

17 Claims, 5 Drawing Sheets

(56) References Cited

U.S. PATENT DOCUMENTS

| | | | | |
|---|---|---|---|---|
| 8,482,378 | B2 | 7/2013 | Sadighi | |
| 8,494,576 | B1 | 7/2013 | Bye | |
| 8,994,498 | B2 | 3/2015 | Agrafioti | |
| 9,773,363 | B2 | 9/2017 | Robinson | |
| 9,779,566 | B2 | 10/2017 | Gammel | |
| 2006/0224891 | A1* | 10/2006 | Ilac | H04L 9/3213 713/171 |
| 2006/0282879 | A1* | 12/2006 | Johnson | H04L 63/1408 726/2 |
| 2008/0150678 | A1 | 6/2008 | Giobbi | |
| 2008/0173709 | A1 | 7/2008 | Ghosh | |
| 2009/0085717 | A1* | 4/2009 | Kirkjan | G07C 9/00309 340/5.2 |
| 2009/0153290 | A1* | 6/2009 | Bierach | H04L 9/32 340/5.6 |
| 2010/0201230 | A1 | 8/2010 | Schweitzer | |
| 2010/0326145 | A1 | 12/2010 | Powers | |
| 2012/0077431 | A1 | 3/2012 | Fyke | |
| 2012/0208549 | A1 | 8/2012 | Lau | |
| 2012/0280790 | A1 | 11/2012 | Gerhardt | |
| 2013/0237193 | A1 | 9/2013 | Dumas | |
| 2013/0257589 | A1 | 10/2013 | Mohiuddin | |
| 2014/0121858 | A1 | 5/2014 | Chen | |
| 2014/0150502 | A1 | 6/2014 | Duncan | |
| 2014/0266585 | A1 | 9/2014 | Chao | |
| 2015/0221152 | A1 | 8/2015 | Andersen | |
| 2016/0014103 | A1 | 1/2016 | Masters | |
| 2016/0117874 | A1* | 4/2016 | Daniel-Wayman | G07C 9/00309 340/5.61 |
| 2017/0046890 | A1 | 2/2017 | Smith | |
| 2017/0046894 | A1 | 2/2017 | Robinson | |
| 2017/0046895 | A1 | 2/2017 | Gammel | |

OTHER PUBLICATIONS

Robinson et al. "RFID Smart Home: Access Control and Automated-Lighting System", Oct. 23, 2008.

* cited by examiner

300

| 302 | 304 | 306 | 308 | 132 |
|---|---|---|---|---|
| Name | User Name | Job Title | Domain Membership(s) | Physical Access Attribute(s) |
| Sally Brown | Sbrown | Technician | UtilityTech | 123523426234123562342342367345 2 |
| Leonard Busey | Lbusey | Administrator | Admins, UtilityTech | 651234123512356123512361264234 4 |
| James Donalds | Jdonalds | Technician | UtilityTech | 612351264235734863467835646234 5 |
| Dena Florham | Dflorham | Technician | UtilityTech | 234517843134572346722345724362 3 |
| Cynthia Griffin | Cgriffin | Technician | UtilityTech | 724465234785237892010123400123 4 |
| Susy Neary | Sneary | Technician | UtilityTech | 123517731243512341234126712346 0 |
| Ada Rizzi | Arizzi | Technician | UtilityTech | 745234534212089740938743019823 8 |
| Edmund Roy | Eroy | Technician | UtilityTech | 847013450870823502519875089253 2 |
| Jack Shuster | Jshuster | Supervisor | Managers, UtilityTech | 613241234616213412616123488283 1 |
| John Smith | Jsmith | Technician | UtilityTech | 712034098723408234123421563270 9 |

Figure 3

LOCAL ACCESS CONTROL SYSTEM MANAGEMENT USING DOMAIN INFORMATION UPDATES

FEDERALLY SPONSORED RESEARCH OR DEVELOPMENT

This invention was made with U.S. Government support under Contract No.: DOE-OE0000680. The U.S. Government may have certain rights in this invention.

TECHNICAL FIELD

This disclosure relates to systems and methods for managing physical access to an access-controlled area of a distributed site of an electric power delivery system and, more particularly, to systems and methods for managing physical access to an access-controlled area using a local access control system configured to receive domain information updates from a domain controller.

BRIEF DESCRIPTION OF THE DRAWINGS

Non-limiting and non-exhaustive embodiments of the disclosure are described, including various embodiments of the disclosure, with reference to the figures, in which:

FIG. 3 illustrates an example of domain information user entries consistent with embodiments disclosed herein.

DETAILED DESCRIPTION

Figure 1:
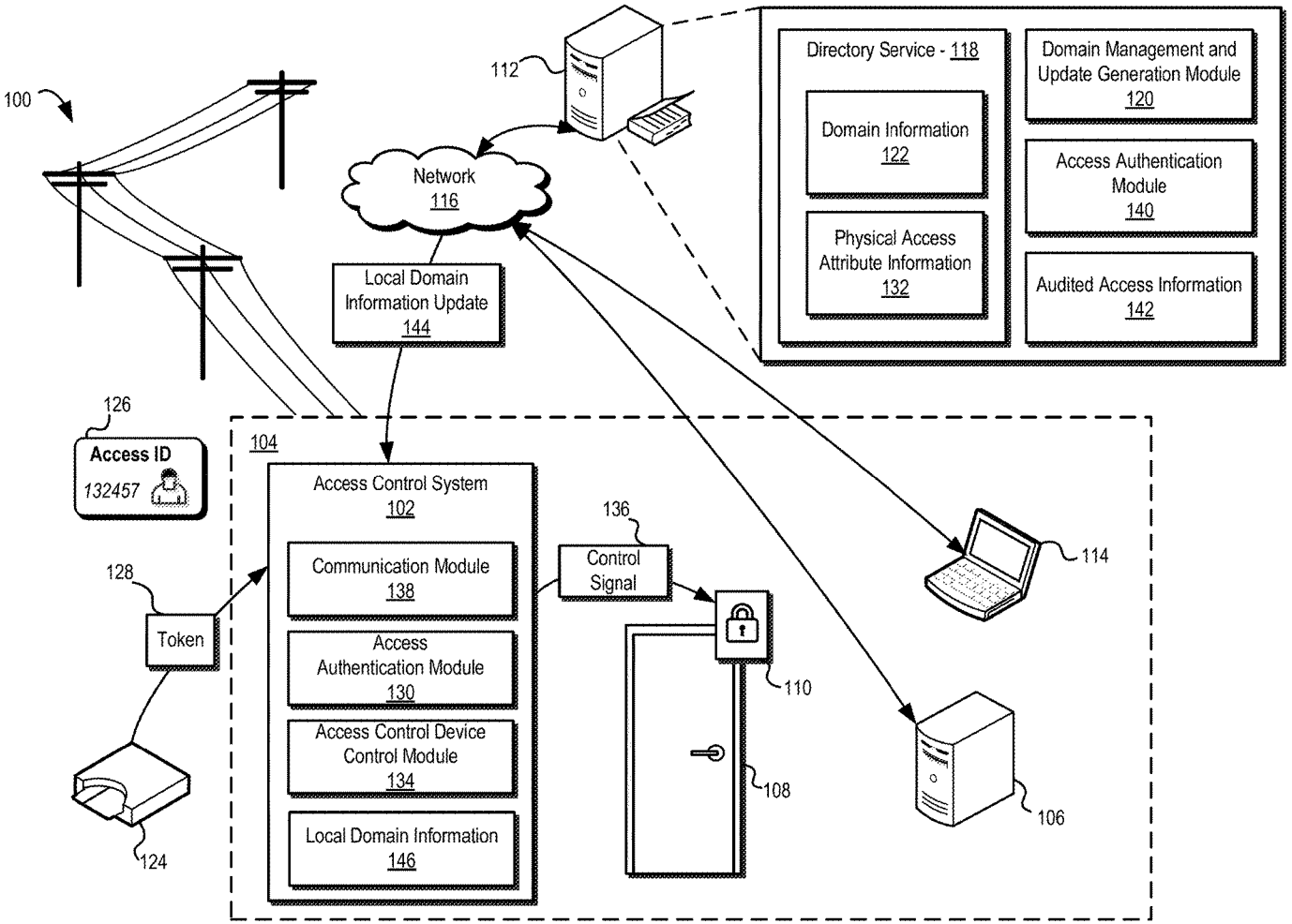
FIG. 1 illustrates an example of a physical access management architecture consistent with embodiments disclosed herein.

The embodiments of the disclosure will be best understood by reference to the drawings. It will be readily understood that the components of the disclosed embodiments, as generally described and illustrated in the figures herein, could be arranged and designed in a wide variety of different configurations. Thus, the following detailed description of the embodiments of the systems and methods of the disclosure is not intended to limit the scope of the disclosure, as claimed, but is merely representative of possible embodiments of the disclosure. In addition, the steps of a method do not necessarily need to be executed in any specific order, or even sequentially, nor do the steps need be executed only once, unless otherwise specified.

In some cases, well-known features, structures, or operations are not shown or described in detail. Furthermore, the described features, structures, or operations may be combined in any suitable manner in one or more embodiments. It will also be readily understood that the components of the embodiments, as generally described and illustrated in the figures herein, could be arranged and designed in a wide variety of different configurations. For example, throughout this specification, any reference to "one embodiment," "an embodiment," or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Electrical power generation and delivery systems are designed to generate, transmit, and distribute electrical energy to loads. Electrical power generation and delivery systems may include a variety of equipment, such as electrical generators, electrical motors, power transformers, power transmission and distribution lines, circuit breakers, switches, buses, transmission and/or feeder lines, voltage regulators, capacitor banks, and/or the like. Such equipment may be monitored, controlled, automated, and/or protected using intelligent electronic devices ("IEDs") that receive electric power system information from the equipment, make decisions based on the information, and provide monitoring, control, protection, and/or automation outputs to the equipment.

In some embodiments, an IED may include, for example, remote terminal units, differential relays, distance relays, directional relays, feeder relays, overcurrent relays, voltage regulator controls, voltage relays, breaker failure relays, generator relays, motor relays, automation controllers, bay controllers, meters, recloser controls, communication processors, computing platforms, programmable logic controllers ("PLCs"), programmable automation controllers, input and output modules, governors, exciters, statcom controllers, access control systems, SVC controllers, OLTC controllers, and the like. Further, in some embodiments, IEDs may be communicatively connected via a network that includes, for example, multiplexers, routers, hubs, gateways, firewalls, and/or switches to facilitate communications on the networks, each of which may also function as an IED. Networking and communication devices may also be integrated into an IED and/or be in communication with an IED. As used herein, an IED may include a single discrete IED or a system of multiple IEDs operating together.

Certain equipment associated with an electrical power generation and delivery system may be distributed in one or more sites and/or locations. For example, a variety of equipment (e.g., IEDs, network equipment, and/or the like) may be associated with a distribution substation location of an electric power delivery system. In some circumstances, distributed sites of an electrical power generation and delivery system may be located in relatively remote and/or infrequently accessed locations. For example, certain distributed sites may be accessed infrequently by individuals performing maintenance, diagnostic, and/or repair activities on equipment associated with the sites (e.g., utility and/or other service personnel).

To ensure the physical security of a distributed site and/or associated equipment, a distributed site may include one or more access control devices including, for example, locks (e.g., electromagnetic, mechanical, and/or solenoid locks), tamper protection devices, security-hardened buildings, enclosures, and/or utility boxes, alarm systems, and/or the like. An access control system in communication with the one or more access control devices may be configured to allow personnel wishing to access the distributed site to authenticate their identity and/or their rights to physically access an associated access-controlled area of the distributed site and/or associated equipment. Based on a successful authentication, the access control system may issue one or more control signals to associated physical access control devices configured to allow the personnel physical access to the access-controlled area of the distributed site and/or associated equipment (e.g., by issuing a control signal configured to disengage a solenoid lock, an alarm system, and/or the like). In some embodiments, the access control system and/or associated devices may establish a secure access-controlled boundary associated with the distributed site.

A variety of computer systems may be included in and/or brought within an access-controlled area. For example, in some embodiments, equipment included in an access-controlled area associated with an electrical power generation and delivery system, including certain IEDs, may comprise one or more computer systems. In further embodiments, personnel entering an access-controlled area may bring a laptop computer system and/or other computing device within the access-controlled area.

In certain embodiments, computer systems included and/or brought within an access-controlled area may be managed by a domain controller computer system. Among other things, the domain controller may manage access to a variety of computing resources associated with one or more computing domains. For example, the domain controller may respond to computing domain security authentication requests from one or more client computer systems associated with a user, may authenticate and/or otherwise authorize access to domain computing resources, and/or may assign and/or enforce access and/or security policies associated with domain resources. In certain embodiments, to access computing resources managed by a domain controller, a user may enter user domain authentication information and/or credentials into an associated computing system that may be verified by the domain controller in connection with domain resource access authentication requests.

Consistent with embodiments disclosed herein, physical access control to an access-controlled area, including management of information used in connection with access control decisions, may be managed by a local access control system in connection with a domain controller using information managed by the domain controller. For example, in certain embodiments, physical access attribute and/or credential information may be managed as part of a user entry in a directory service managed by the domain controller. Using this information, the domain controller and/or a communicatively coupled access control system may perform physical access control determinations based on physical access control requests received from a user wishing to gain physical access to an access-controlled area.

In certain circumstances, connectivity between a domain controller and an access control system associated with a distributed site may become interrupted (e.g., during a network interruption event or the like). In other circumstances, communication between a domain controller and an access control system may become bandwidth limited, thereby reducing the ability of the access control system and the domain controller to communicate effectively in connection with physical access control determinations.

Consistent with embodiments disclosed herein, certain information used in access control determinations managed by a domain controller may be communicated to an access control system for use in connection with certain local access control determinations performed by the access control system when a communication channel(s) between the domain controller and the access control system is active. In some embodiments, local access control determinations may be performed locally by the access control system without actively communicating with the domain controller when communication with the domain controller is interrupted and/or otherwise limited. In certain embodiments, the information may be communicated from the domain controller in the form of domain information updates that include information managed as part of directory service user information relevant to a particular access control system. In some embodiments, domain information updates may be compressed and/or signed. Using domain information update information, an access control system may maintain local domain information and use such information in connection with local access control determinations. Embodiments of the disclosed systems and methods may, among other things, reduce network interactions involved in bringing access control information managed locally by an access control system up-to-date for use in connection with local (e.g., offline) access control determinations.

In certain embodiments, domain information updates may be prepared by a domain controller for transmission to access control systems periodically, based on the occurrence of one or more events, based on request from the access control system, and/or the like. In some embodiments, the domain information updates may comprise associated version information (e.g., version numbers and/or the like) that may be used in connection with determining which domain information updates should be sent to a local access control system, thereby reducing associated network interactions.

Several aspects of the embodiments described herein are illustrated as software modules or components. As used herein, a software module or component may include any type of computer instruction or computer executable code located within a memory device that is operable in conjunction with appropriate hardware to implement the programmed instructions. A software module or component may, for instance, comprise one or more physical or logical blocks of computer instructions, which may be organized as a routine, program, object, component, data structure, etc., that performs one or more tasks or implements particular abstract data types.

In certain embodiments, a particular software module or component may comprise disparate instructions stored in different locations of a memory device, which together implement the described functionality of the module. Indeed, a module or component may comprise a single instruction or many instructions, and may be distributed over several different code segments, among different programs, and across several memory devices. Some embodiments may be practiced in a distributed computing environment where tasks are performed by a remote processing device linked through a communications network. In a distributed computing environment, software modules or components may be located in local and/or remote memory storage devices. In addition, data being tied or rendered together in a database record may be resident in the same memory device, or across several memory devices, and may be linked together in fields of a record in a database across a network.

Embodiments may be provided as a computer program product including a non-transitory machine-readable medium having stored thereon instructions that may be used to program a computer or other electronic device to perform processes described herein. The non-transitory machine-readable medium may include, but is not limited to, hard drives, floppy diskettes, optical disks, CD-ROMs, DVD-ROMs, ROMs, RAMs, EPROMs, EEPROMs, magnetic or optical cards, solid-state memory devices, or other types of media/machine-readable medium suitable for storing electronic instructions. In some embodiments, the computer or other electronic device may include a processing device such as a microprocessor, microcontroller, logic circuitry, or the like. The processing device may further include one or more special purpose processing devices such as an application specific interface circuit ("ASIC"), PAL, PLA, PLD, field programmable gate array ("FPGA"), or any other customizable or programmable device.

FIG. 1 illustrates an example of a physical access management 100 architecture consistent with embodiments disclosed herein. In certain embodiments, an access control system 102 may be associated with an access-controlled area 104 of a distributed site of an electric power generation and delivery system. Consistent with embodiments disclosed herein, the access control system 102 may be configured to manage physical access to the access-controlled area 104 and/or various equipment and/or computing systems 106 located within the access-controlled area 104. Although illustrated in connection with an access-controlled area 104 of a distributed site of an electric power generation and delivery system, it will be appreciated that embodiments of the disclosed systems and methods may be utilized in connection with a variety of access-controlled areas.

The access-controlled area 104 may include a variety of equipment associated with the electric power generation and delivery system including, for example, one or more IEDs, network communication equipment, electrical generators, electrical motors, power transformers, power transmission and distribution lines, circuit breakers, switches, buses, transmission and/or feeder lines, voltage regulators, capacitor banks, computer systems 106, and/or the like. In certain embodiments, the access-controlled area 104 may comprise a subset of equipment associated with a distributed location of an electric power generation and/or delivery system (e.g., a portion of a distribution substation). For example, in some embodiments, the access-controlled area 104 may comprise a distribution substation of an electric power delivery system. In further embodiments, the access-controlled area 104 may comprise a panel and/or utility box housing equipment associated with an electrical power generation and/or delivery system.

Physical access to the access-controlled area 104 and/or equipment associated with the same may be facilitated via one or more access points 108. As illustrated, the access point 108 may comprise a door to a building associated with the access-controlled area 104. In further embodiments, the access point 108 may include one or more panels and/or boxes facilitating access to equipment housed therein. In yet further embodiments, the access point 108 may be associated with a particular piece of equipment (e.g., an IED or the like) within the access-controlled area 104. For example, the access point 108 may comprise an access panel to a particular piece of equipment within the access-controlled area 104.

Physical access by one or more users (not shown) to the access-controlled area 104 using the one or more access points 108 may be managed by one or more access control devices 110 associated with an access point 108. In certain embodiments, an access control device 110 may be controlled by the access control system 102 using to one or more control signals 136. The access control devices 110 may comprise one or more locks (e.g., electromagnetic, mechanical, and/or solenoid locks), alarm systems, and/or the like. For example, in certain embodiments, an access control device 110 may comprise an electronically actuated lock for a door.

Physical access to the access-controlled area 104 may be managed, at least in part, by an access control system 102 and/or a domain controller 112. The access control system 102, the domain controller 112 and/or other associated systems (e.g., computer systems 106, 114) may comprise any suitable computing system or combination of systems configured to implement embodiments of the systems and methods disclosed herein. In certain embodiments, the access control system 102, the domain controller 112, the computer systems 106, 114 and/or other associated systems may comprise at least one processor system configured to execute instructions stored on an associated non-transitory computer-readable storage medium. In some embodiments, the access control system 102, the domain controller 112, the computer systems 106, 114 and/or other associated systems may further comprise secure execution space configured to perform sensitive operations such as authentication credential validation, policy management and/or enforcement, and/or other aspects of the systems and methods disclosed herein. The access control system 102, the domain controller 112, the computer systems 106, 114 and/or other associated systems may further comprise software and/or hardware configured to enable electronic communication of information between the systems 102, 106, 112, 114 via one or more associated network connections (e.g., network 116).

The access control system 102, the domain controller 112, the computer systems 106, 114 and/or other associated systems may comprise a computing device executing one or more applications configured to implement embodiments of the systems and methods disclosed herein. In certain embodiments, the access control system 102, the domain controller 112, the computer systems 106, 114 and/or other associated systems may comprise a laptop computer system, a desktop computer system, an IED, a server computer system and/or any other computing system and/or device that may be utilized in connection with the disclosed systems and methods.

The various systems 102, 106, 112, 114 may communicate via one or more networks comprising any suitable number of networks and/or network connections. For example, as illustrated, the access control system 102 and/or computer systems 106, 114 may communicate with the domain controller 112 via network 116. The network connections may comprise a variety of network communication devices and/or channels and may utilize any suitable communication protocols and/or standards facilitating communication between the connected devices and systems. The network connections may comprise the Internet, a local area network, a virtual private network, and/or any other communication network utilizing one or more electronic communication technologies and/or standards (e.g., Ethernet or the like). In some embodiments, the network connections may comprise a wireless carrier system such as a personal communications system ("PCS"), and/or any other suitable communication system incorporating any suitable communication standards and/or protocols. In further embodiments, the network connections may comprise an analog mobile communications network and/or a digital mobile communications network utilizing, for example, code division multiple access ("CDMA"), Global System for Mobile Communications or Groupe Special Mobile ("GSM"), frequency division multiple access ("FDMA"), and/or time divisional multiple access ("TDMA") standards. In certain embodiments, the network connections may incorporate one or more satellite communication links. In yet further embodiments, the network connections may utilize IEEE's 802.11 standards (e.g., Wi-Fi®), Bluetooth®, ultra-wide band ("UWB"), Zigbee®, and/or any other suitable communication protocol(s).

In certain embodiments, certain computer systems (e.g., systems 106, 114) associated with the access-controlled area 104 may be managed by a domain controller 112. Among other things, the domain controller 112 may manage access by the systems 106, 114 to a variety of computing resources associated with one or more computing domains. For example, the domain controller 112 may receive computing domain security authentication requests from the computing systems 106, 114, may authenticate and/or otherwise authorize requested access to domain computing resources, and/or may assign and/or enforce access and/or security policies associated with domain resources.

In certain embodiments, the domain controller 112 may include a directory service 118 used in connection with domain management activities. The directory service 118 may comprise a database of domain information 122 that may include, among other things, one or more entries associated with domain users. The user entries may comprise information identifying a user, user domain login information (e.g., passwords and/or the like), and/or information relating to access rights and or roles within computing domains associated with the user. The directory service 118 may further include one or more executable module(s) configured to service access requests and maintain the database.

In some embodiments, certain domain management and/or domain resource management activities may be performed by a domain management module 120 executing on the domain controller 112 utilizing the domain information 122 managed by the directory service 118. As an example, when a user logs into a computer system that is part of an associated computing domain (e.g., computer system 106, 114), the domain management module 120 and/or the directory service 118 may authenticate a password provided by the user in connection with the login process and determine associated access rights to domain resources (e.g., determine whether the user is a system administrator and has rights to access administrator resources and/or the like). In some embodiments, the domain authentication process may utilize the domain information 122 included in the directory service 118. As discussed in more detail below, consistent with embodiments disclosed herein, the domain management module 120 may further be configured to perform certain local domain information generation and/or distribution activities in connection with provisioning local access control systems 102 with local domain information 146 and/or updates 144 to the same. Although illustrated as a separate module, it will be appreciated that in certain embodiments, the domain management module 120 may be a part of the directory service 118.

To gain physical access to the access-controlled site 104, a user may interact with one or more physical access control interfaces 124 (e.g., keypads, buttons, biometric scanners, badge and/or card readers, and/or the like) in communication with the access control system 102. In some embodiments, the physical access control interface 124 may comprise a card reader configured to read information stored on an access card 126 presented by a user. In further embodiments, the physical access control interface 124 may comprise a touchscreen, a keyboard, a mouse, a track pad, and/or any other suitable interface associated with the access control system 102. In yet further embodiments, the interface 124 may comprise a physical key and/or electronic 10-digit key pad (e.g., a keypad displayed on a touchscreen interface).

Using the physical access control interface 124, a user may enter authentication credentials for authenticating their rights to physically access the access-controlled area 104. For example, as illustrated, a user may present an access card 126 to a physical access control interface 124 comprising a card reader. Authentication credentials stored on the card 126 such as a token 128 may be read from the access card 126 and communicated to the communicatively coupled access control system 102 for use in connection with a physical access authentication determination, as discussed in more detail below.

In other embodiments, a user may provide the access control system 102 with authentication credentials such as a personal identification number ("PIN") or the like via a keypad interface. In further embodiments, authentication credentials provided to the access control system 102 may comprise any type of numeric (e.g., a PIN), alphanumeric, symbolic, biometric sensor input, information received from a security key or card in communication with the interface (e.g., using a near field communication ("NFC") standard), and/or the like. Although embodiments disclosed herein are discussed in the context of using a token 128 stored on an access card 126 read by a physical access control interface 124 comprising a card reader, it will be appreciated that a variety of types of authentication credentials and associated physical access control interfaces may be used in connection with the disclosed embodiments.

After receiving the token 128, the access control system 102 may initiate a physical access authentication process using a control system access authentication module 130 executing thereon to determine whether the user providing the access card 126 has rights to physically access the access-controlled area 104. In certain embodiments, the access control system may communicate with the domain controller using a communication module 138 to access physical access attribute information 132 managed by the directory service 118. For example, in some embodiments, a database associated with the directory service 118 may include physical access attribute information 132 as part of an entry associated with managed domain users. Although illustrated as being separate, it will be appreciated that in certain embodiments, domain information 122 and physical access attribute information 132 may be included in a single database storing domain and physical access information in entries associated with various domain users.

The authentication module 130 may comprise software and/or hardware configured to authenticate the validity of the authentication credentials (e.g., token 128) provided to the physical access control system 102 and/or determine whether a user associated with the credentials has current rights to physically access the access-controlled area 104. The access authentication module 130 may further interact with an access control device control module 134 executing on the physical access control system 102 in connection with issuing one or more responses and/or control signals 136 to access control devices 110 configured to effectuate access control decisions.

In connection with a physical access authentication process, the authentication module 130 may compare the received credentials and/or token 128 with the physical access attribute information 132 managed by the directory service 118 of the domain controller 112 to determine if the credentials and/or token 128 are associated with a user having current access rights to the access-controlled area 104. If the credentials and/or token 128 are associated with a user having current access rights, the access control system 102 may issue one or more control signals 136 to an access control device 110 associated with an access point 108 of the access-controlled area 104. In certain embodiments, the control signal 124 may actuate a lock associated with the access point 108, may disable an alarm system associated with the access point 108, and/or the like. In further embodiments, a response indicating a successful authentication of the authentication credentials may be communicated from the access control system 102 to an associated interface 124 and/or the domain controller 112. In some embodiments, if the credentials and/or token 128 are not associated with a user having current access rights, the access control system 102 may issue one or more control signals 136 configured to prevent and/or otherwise disable physical access to the access-controlled area 104.

In certain circumstances, connectivity between a domain controller 112 and an access control system 102 associated with an access-controlled area 104 may become interrupted. For example, one or more communication channels associated with network 116 may become interrupted due to a variety of events (e.g., natural disasters, network hardware failures, weather, etc.). In other circumstances, communication may between a domain controller 112 and an access control system 102 may become bandwidth limited, thereby reducing the ability of the access control system 102 and the domain controller 1102 to communicative effectively in connection with physical access control determinations.

Consistent with embodiments disclosed herein, certain information that may be used in access control determinations managed by the domain controller 112 may be communicated to an access control system 102 for use in connection with certain local access control determinations performed by the access control system 102 independent of the domain controller 112 (e.g., access control determinations when communication with the domain controller 112 is interrupted and/or otherwise limited). In certain embodiments, such local access control determinations may be performed by an access control system 102 upon a determination by the access control system 102 that communication with a domain controller 102 has been interrupted and/or is otherwise limited. In other embodiments, local access control determinations may performed by the access control system 102 by default regardless of the state of communication between the access control system 102 and the domain controller 112. Among other things, embodiments of the disclosed systems and methods may allow for accurate access control determinations to be performed based on access control information 146 stored locally by an access control system 102 regardless of its connectivity to an associated domain controller 112.

In certain embodiments, information used in connection with local access control determinations may be maintained by the access control system 102 as part of local domain information 146. Local domain information 146 may include, without limitation, domain information 122, physical access attribute information 132 and/or any other information maintained as part of the directory service 118. In further embodiments, the local domain information 146 may comprise a subset of the domain information 122, physical access attribute information 132 and/or other information maintained as part of the directory service 118 associated with the particular access control system 102. For example, the local domain information 146 may comprise a subset of information managed by the domain controller 112 relevant to users, groups of users, and/or any other entity associated with a particular access control system 102 and/or that otherwise may wish to authenticate their physical access rights to the access-controlled area 104 with the access control system 102.

In certain embodiments, information included in the local domain information 146 may be generated by a domain management module 120 executed by the domain controller 112. The domain management module 120 may be further configured to perform certain activities in connection with provisioning local access control systems 102 with relevant local domain information 146. In some embodiments, an access control system 102 may subscribe with the domain controller 112 in connection with receiving relevant local domain information 146. For example, the access control system 102 may identify to the domain management module 120 certain associated users, groups, and/or the like. Based on the identified users, groups, and/or the like, the domain management module 120 may identify relevant domain information 122, physical access attribute information 132 and/or other information maintained as part of the directory service 118, and may distribute such information to the access control system 102 for use in connection with local physical access control determinations.

In other embodiments, in addition and/or in lieu of being explicitly specified, relevant local domain information 146 may be identified based on tracking physical access determination requests over time to the access-controlled area 104. For example, the access control system 102 and/or the domain controller 112 may track physical access requests to the access-controlled area 104 to identify users, groups, and/or the like that request access with some threshold amount of frequency, and may distribute associated local domain information 146 associated with such users, groups, and/or the like for use in connection with local physical access control determinations performed by the access control system 102.

In connection with a local physical access authentication process, the authentication module 130 may compare received credentials and/or tokens 128 with the physical access attribute information included in the local domain information 146 to determine if the credentials and/or token 128 are associated with a user having current access rights to the access-controlled area 104. If the credentials and/or token 128 are associated with a user having current access rights, the access control system 102 may issue one or more control signals 136 to an access control device 110 associated with an access point 108 of the access-controlled area 104. In certain embodiments, the control signal 124 may actuate a lock associated with the access point 108, may disable an alarm system associated with the access point 108, and/or the like. In further embodiments, a response indicating a successful authentication of the authentication credentials may be communicated from the access control system 102 to an associated interface 124 and/or the domain controller 112. In some embodiments, if the credentials and/or token 128 are not associated with a user having current access rights, the access control system 102 may issue one or more control signals 136 configured to prevent and/or otherwise disable physical access to the access-controlled area 104. In other embodiments, the access control system 102 may prevent and/or otherwise disable physical access to the access-controlled area 104 without a issuing a control system that allows access to the access-controlled area 104 (e.g., by not issuing and/or otherwise issuing a signal actuating a lock and/or the like).

In some embodiments, local domain information 146 and/or a subset thereof may be communicated from the domain controller 112 in the form of local domain information updates 144. For example, when information managed by the domain controller 112 relevant to a particular access control system 102 is changed and/or otherwise updated (e.g., domain information 122 and physical access attribute information 132), the domain management module 120 may generate a local domain information update 144 and distribute the update 144 to the access control system 102. The access control system 102 may use the local domain information update 144 to update the location domain information 146 maintained thereon, which in turn may be used in connection with future local access control determinations. In this manner, relevant changes to centralized information managed by the domain controller 112 (e.g., directory service 118 information) may distributed and reflected in local domain information 146 associated with distributed access control systems 102.

In certain embodiments, local domain information updates 144 may be generated and distributed from the domain controller 112 to subscribing access control systems 102 using a push model. For example, a user of the domain controller 112 and/or another computer system (e.g., system 114 or the like) configured to interface with the domain controller 112 may make a change to an entry included the directory service 118 (e.g., a change to domain information 122 and/or physical access attribute information 132).

Following the change, the domain management module 120 may determine whether any entries associated with the change are relevant to and/or otherwise associated with a subscribing access control system 102. For example, the domain management module 120 may determine that a changed entry is associated with a user, a group of users, and/or an entity that requests with some threshold frequency to authenticate their physical access rights to the access-controlled area 104 with the access control system 102. In other embodiments, the domain management module 120 may use version information and/or data hashes to determine whether any entries associated with a change are relevant to and/or otherwise associated with a subscribing access control system 102. The domain management module 120 may generate a local domain information update 144 and transmit the update 144 (i.e., "push" the update) to the access control system 102 for use in connection with updating the local domain information 146 managed thereon. In this manner, a change to information included in the directory service 118 may trigger the generation of a local domain information update 144 and transmission of the update 144 from the domain controller 112 to access control system 102. In further embodiments, updates 144 may be generated and/or otherwise transmitted to the access control system 102 from the domain controller 112 upon request and/or a in response to a poll event (e.g., as may be the case in a "pull" model) and/or based on the access control system 102 subscribing to received certain updates 144 from the domain controller 112.

In further embodiments, local domain information updates 144 may be generated and distributed from the domain controller 112 to subscribing access control systems 102 using a pull model. For example, in certain embodiments, the local access control system 102 may poll the domain controller 112 to determine whether information managed by the domain controller 112 (e.g., directory service 118 information) relevant to physical access control determinations performed by the access control system 102 has been updated and/or otherwise changed. In some embodiments, the access control system 102 may transmit a timestamp and/or version indication to the domain controller 112 as part of the polling process which may be used to determine whether an update should be performed. In response to the polling, the domain controller 112 may determine whether a change as occurred and, if so, may generate a local domain information update 144 and transmit the update 144 to the access control system 102 for use in connection with updating the local domain information 146 managed thereon.

In some embodiments, polling may be performed periodically. For example, the access control system 102 may poll the domain controller 112 for local domain information updates 144 every 24 hours and/or the like when the access control system 102 has connectivity with the domain controller 112. In other embodiments, polling may be event-based. For example, the access control system 102 may poll the domain controller 112 for local domain information updates 144 when the access control system 102 initiates and/or shuts down, at every and/or a subset of connection events with the domain controller 112 (e.g., when the access control system 102 is reconnected to the domain controller 112 following an interruption) and/or upon the occurrence of any other suitable event.

In certain embodiments, local domain information updates 144 may comprise information that is compressed and/or otherwise configured to reduce network traffic between the access control system 102 and/or the domain controller 112. Local domain information updates 144 may further comprise integrity check information (e.g., digital signatures and/or the like) that may be utilized by the access control system 102 and/or any module executing thereon to verify the integrity of the update 144.

In certain embodiments, the access control system 102 and/or the domain controller 112 may implement multi-factor authentication processes (e.g., a two-factor authentication process) in connection with managing physical access to the access-controlled area 104. In certain embodiments, authentication processes consistent with embodiments disclosed herein may include, without limitation, knowledge factor authentication (e.g., demonstrating knowledge of a password, a passphrase, a PIN, a challenge response, a pattern, etc.), ownership or possession factor authentication (e.g., demonstrating possession of a security and/or an identification card, a security token, a hardware token, a software token, a security key, etc.), and/or inherence and/or biometric factor authentication (e.g., providing fingerprint, retina, signature, voice, facial recognition, and/or other biometric identifiers), and/or the like.

In some embodiments, data relating to physical access to the access-controlled area 104 may be generated and stored by the access control system 102, the domain controller 112, and/or any other associated system (e.g., stored by the domain controller 112 as audited access information 142 and/or the like). Such audited access information 142 may comprise, without limitation, information regarding which user physically accessed the access-controlled area 104, a time of such access, and/or any other information relating to such access. Among other things, audited access information 142 may be utilized in connection with comprehensive physical and cybersecurity management activities relating to the access-controlled area 104.

It will be appreciated that a number of variations can be made to the architecture and relationships presented in connection with FIG. 1 within the scope of the inventive body of work. For example, without limitation, in some embodiments, some or all of the functions performed by the access control system 102 may be performed by the domain controller 112 and/or one or more other associated systems as discussed above. In further embodiments, physical access control and resource management consistent with the disclosed embodiments may be implemented in any combination of suitable systems. Thus it will be appreciated that the architecture and relationships illustrated in FIG. 1 are provided for purposes of illustration and explanation, and not limitation.

Figure 2:
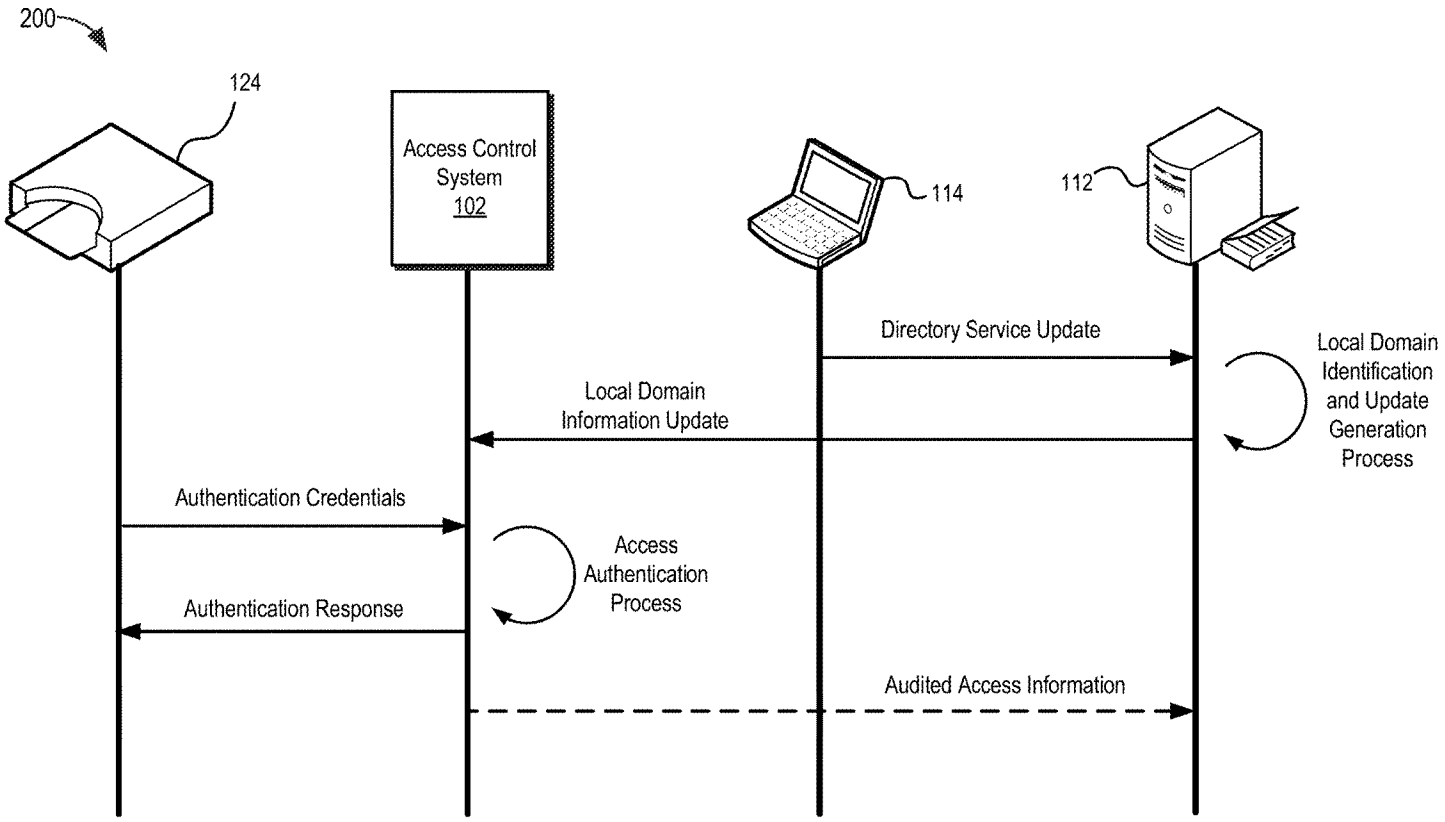
FIG. 2 illustrates a diagram showing an example of a physical access management process consistent with embodiments disclosed herein.

FIG. 2 illustrates a diagram 200 showing an example of a simplified physical access management process consistent with embodiments disclosed herein. The physical access management process may be used to manage physical access to an access-controlled area using an access control system 102. As discussed above, a physical access control interface 124, an access control system 102 associated with the access-controlled area and/or a domain controller 112 may be utilized in connection with managing physical access to the access-controlled area consistent with embodiments of the disclosed systems and methods.

Using an interface of the domain controller 112 and/or a communicatively coupled computer system 114, a user may interface with the domain controller 112 to update directory service information managed thereon. For example, a user, having certain administrative rights to do so, may add an entry into a directory service managed by the domain controller 112 and/or otherwise update information included the directory service (e.g., authorized user information, domain information, physical access attribute information, etc.).

The domain controller 112 may engage in a local domain information update generation process based on the received directory service update. In certain embodiments, this process may be initiated based on the occurrence of some event (e.g., based on receipt of the update and/or receipt of a polling request from an associated access control system 102) and/or periodically. In some embodiments, the domain controller 112 may determine whether any entries associated with the directory service update are relevant to and/or otherwise associated with a subscribing access control system 102. If so, the domain controller 112 may generate a local domain information update reflecting the directory service update and distribute the local domain information update to associated access control systems 102. In some embodiments, the local domain information update may be generated and/or distributed in response to requests issued from the access control systems 102. Upon receipt of the local domain information update, the access control system 102 may update local domain information managed thereon used in connection with local physical access authentication determinations (e.g., determinations when communication with the domain controller 112 is unavailable and/or otherwise limited).

To authenticate their rights to physically access an access-controlled area, a user may provide certain authentication credentials to a physical access control interface 124 associated with the access-controlled area. For example, as illustrated, a user may present an access card to a physical access control interface 124 comprising a card reader. Authentication credentials stored on the card such as a token may be read from the physical access control interface 124 and communicated to an associated access control system 102. Although illustrated in connection with a single-factor authentication process, it will be appreciated that embodiments of the disclosed systems and methods may also be used in connection with multi-factor authentication processes.

Upon receipt of the authentication credentials, the access control system 102 may perform a local physical access authentication determination process to determine whether the authentication requested should be granted. Although not specifically illustrated, in certain embodiments, prior to performing the local physical access authentication request, the access control system 102 may determine that communication with the domain controller 112 is interrupted and/or otherwise limited. For example, the access control system 102 may attempt to contact the domain controller 112 to perform a physical access authentication and/or authorization determination. If the domain controller 112 is unavailable and/or the response time is too slow, the access control system 102 may perform a local physical access authentication determination based on locally-stored domain information.

In some embodiments, the access control system 102 may compare the received credentials with physical access attribute information included in local domain information managed by the access control system 102 to determine if the credentials are associated with a user having current physical access rights to the access-controlled area. Based on the results of the determination, the access control system 102 may generate an authentication response and/or issue one or more control signals to one or more access control devices (not shown) configured to effectuate the access control decision.

In some embodiments, when a physical access authentication determination is performed by the domain controller 112 and a result is communicated back to an access control system 102 (e.g., as may be the case when the access control system 102 can communicate with the domain controller 112), the access control system 102 may perform a local access control determination to determine if the locally-determined response is the same as the response generated by the domain controller 112. Same resulting responses may provide an indication that locally-stored domain information managed by the access control system 102 is up-to-date with information managed by the domain controller. If the resulting responses differ, however, the access control system 102 may implement an access control decision based on the result provided by the domain controller 112 (e.g., defaulting to the access control decision result provided by the domain controller 112) and/or request an update from the domain controller 112 to the locally-stored domain information.

In further embodiments, the access control system 102 may further transmit an indication of the authentication result to an interface associated with the first user (e.g., the physical access control interface 124 or the like). In some embodiments, audited access information relating to the user's interactions with the access control system 102 may be generated and/or transmitted from the access control system 102 to the domain controller 112 and/or another service. In certain embodiments, if communication between the access control system and/or the domain controller is interrupted and/or otherwise limited, the access control system 102 may store the audited access information locally for later transmission when communication is restored and/or otherwise reestablished.

FIG. 3 illustrates an example of domain information user entries 300 consistent with embodiments disclosed herein. As discussed above, in certain embodiments, an access control system may manage local domain information that includes a database of information comprising one or more entries 300 associated with various users for use in connection with local access control determinations.

In certain embodiments, information included in the local domain information user entries 300 may include physical access attribute information 132 used in connection with local physical access request determinations performed by an access control system. In some embodiments, the physical access attribute information 132 may include physical access credentials and/or token information associated with one or more users (e.g., users 302), and may include any of the types of physical access credential information disclosed herein. For example, as illustrated, the physical access attribute information 132 may comprise alphanumeric tokens that may be stored on physical access cards issued to each user associated with the directory service user entries 300. In further embodiments, information included in the local domain information user entries 300 may further include names of users 302, associated computing domain usernames 304, job titles and/or associated user role information 306 (e.g., user, administrator, supervisor, etc.), domain membership information 308 (e.g., administrator domains, user domains, etc.), and/or the like.

Figure 4:
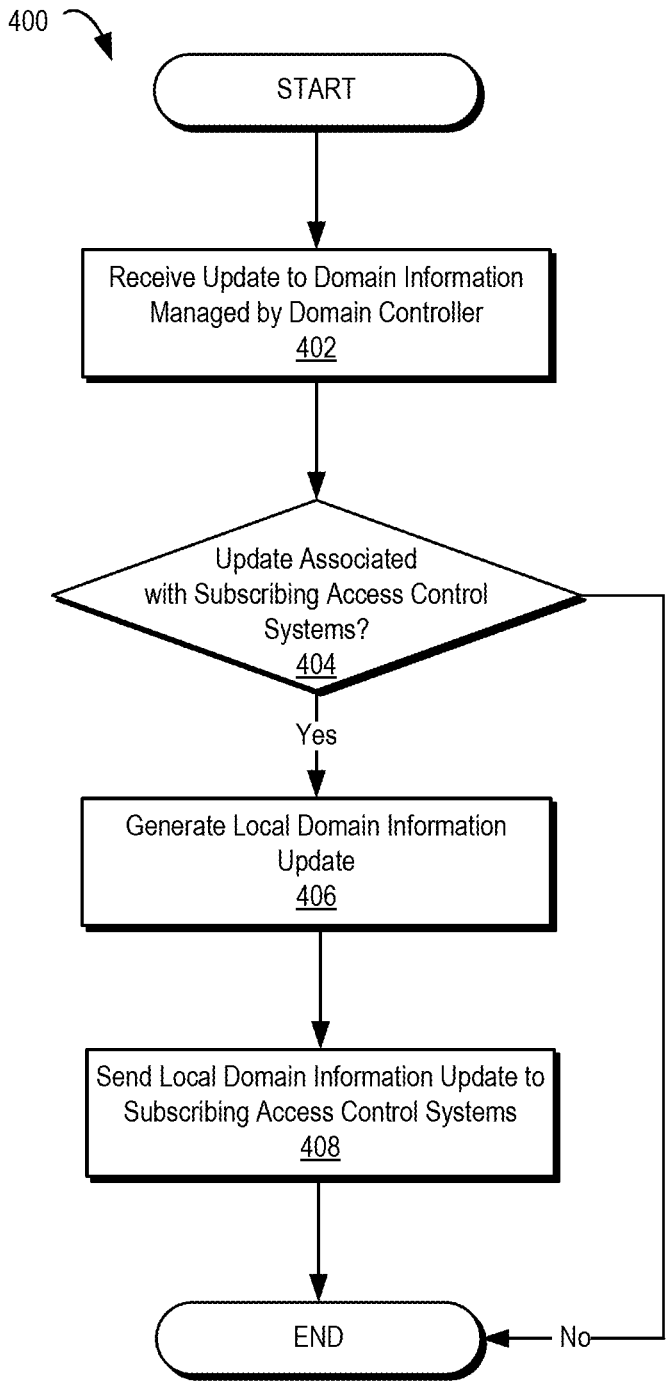
FIG. 4 illustrates a flow chart of a method for generating and distributing local domain information updates consistent with embodiments disclosed herein.

FIG. 4 illustrates a flow chart of a method 400 for generating and distributing local domain information updates consistent with embodiments disclosed herein. In certain embodiments, elements of the method 400 may be performed by a domain controller. At 402, an update and/or otherwise change to domain information, which may include physical access attribute information, included in a directory service managed by the domain controller may be received. Although method 400 is illustrated in connection with a push model, it will be appreciated that in other embodiments, a pull model and/or any other suitable distribution model may be utilized.

At 404, the domain controller may determine whether any entries associated with the domain information update received at 402 are relevant to and/or otherwise associated with one or more subscribing access control systems. In certain embodiments, this determination may be initiated based on the occurrence of some event (e.g., based on receipt of the update and/or receipt of a polling request from an access control system) and/or periodically. If any entries associated with the domain information update received at 402 are relevant to and/or otherwise associated with one or more subscribing access control systems, the domain controller may proceed to 406, where a local domain information update may be generated. Otherwise, the method 400 may proceed to end.

Generated local domain information updates may be sent to associated subscribing access control systems at 408. In some embodiments, the local domain information updates may be compressed prior to transmission to the subscribing access control system(s). In further embodiments, check information may be included in the transmitted local domain information updates configured to allow a receiving access control system to verify the integrity of the information included in the updates.

Figure 5:
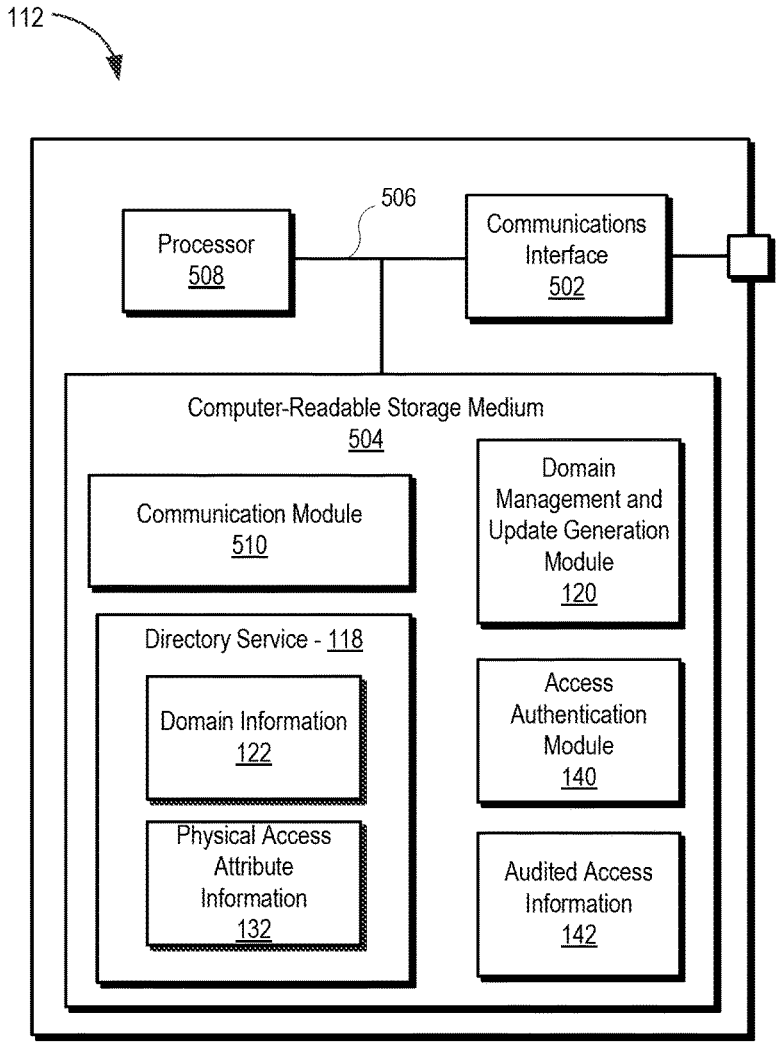
FIG. 5 illustrates a functional block diagram of a domain controller consistent with embodiments disclosed herein.

FIG. 5 illustrates a functional block diagram of a domain controller 112 configured to manage one or more resources consistent with embodiments disclosed herein. Embodiments of the domain controller 112 may be utilized to implement embodiments of the systems and methods disclosed herein. For example, the domain controller 112 may be configured to interact with an access control system in connection with managing physical access to an access-controlled area.

The domain controller 112 may include a communications interface 502 configured to communicate with a communication network. In certain embodiments, the communications interface 502 may comprise a wired and/or wireless communication interface configured to facilitate communication with a network, other systems and/or devices, and/or mobile devices. For example, in some embodiments, the domain controller 112 may be configured to securely communicate with an access control system in connection with receiving polling requests for local domain information updates, transmitting local domain information updates, receiving audited access information 142, and/or the like.

A computer-readable storage medium 504 may be the repository of one or more modules and/or executable instructions configured to implement any of the processes described herein. A data bus 506 may link the communications interface 502, and the computer-readable storage medium 504 to a processor 508. The processor 508 may be configured to process communications received via the communications interface 502. The processor 508 may operate using any number of processing rates and architectures. The processor 508 may be configured to perform various algorithms and calculations described herein using computer executable instructions stored on computer-readable storage medium 504.

The computer-readable storage medium 504 may be the repository of one or more modules and/or executable instructions configured to implement certain functions and/or methods described herein. For example, the computer-readable storage medium 504 may include one or more access authentication modules 140 configured to perform embodiments of the physical access authentication methods disclosed herein and/or one or more domain management modules 120 configured to perform certain domain information management and/or local domain information update generation. The computer-readable medium 504 may further include a communication module 510, a directory service 118, and/or audited access information 142.

A communication module 510 may include instructions for facilitating communication of information from the domain controller 112 to other controllers, systems, devices (e.g., access control devices), resources, transient assets and/or other components in the electric power delivery system and/or a distributed site associated with the same. The communication module 510 may include instructions on the formatting of communications according to a predetermined protocol. In certain embodiments, the communication module 510 may be configured to issue one or more control signals to associated access control systems configured to effectuate a particular access control decision. The communication module 510 may be configured with subscribers to certain information, and may format message headers according to such subscription information.

While specific embodiments and applications of the disclosure have been illustrated and described, it is to be understood that the disclosure is not limited to the precise configurations and components disclosed herein. For example, the systems and methods described herein may be applied to a variety of distributed sites of an electric power generation and delivery system. It will further be appreciated that embodiments of the disclosed systems and methods may be utilized in connection with a variety of systems, devices, and/or applications utilizing physical access control systems and methods, and/or applications that are not associated with and/or are otherwise included in an electric power delivery system. Accordingly, many changes may be made to the details of the above-described embodiments without departing from the underlying principles of this disclosure. The scope of the present invention should, therefore, be determined only by the following claims.

What is claimed is:

1. An access control system associated with an access-controlled area of a distributed site of an electric power delivery system, the system comprising:

a credential input interface configured to receive authentication credentials from a user;

a communications interface communicatively coupled to an access control device associated with the access-controlled area and a domain controller associated with the access control system, the domain controller managing a directory service comprising a plurality of user entries, each user entry comprising physical access attribute information;

a processor communicatively coupled to the credential input interface and the communications interface;

a computer-readable storage medium communicatively coupled to the processor, the computer-readable storage medium storing executable program instructions that cause the processor to:

receive, via the communications interface from the domain controller, local domain update information, the local domain update information comprising at least a subset of the plurality of user entries included in the directory service managed by the domain controller;

store the local domain update information within local domain information managed by the access control system;

determine, based on the received authentication credentials and the local domain information, whether the authentication credentials are associated with a user entry having current access rights to the access-controlled area;

generate, based on the determination, an access control signal configured to implement an access control action by the access control device;

transmit, via the communications interface, the access control signal to the access control device;

generate, based on the determination, a logical access control signal configured to implement a logical access control determination by a resource included in the access-controlled area; and transmit, via the communications interface, the logical access control signal to the resource.

2. The access control system of claim 1, wherein the authentication credentials comprise at least one of a personal identification number, a password, a passphrase, a response to a challenge, a pattern, information stored on a card, information stored on a security token, information stored on a hardware token, information stored on a software token, and biometric identification information.

3. The access control system of claim 1, wherein the access control signal is configured to cause the access control device to actuate a lock associated with the access-controlled area.

4. The access control system of claim 1, wherein the access control signal is configured to cause the access control device to change a status of an alarm system associated with the access-controlled area.

5. A method performed by an access control system associated with an access-controlled area of a distributed site of an electric power delivery system, the method comprising:

receiving, from a communicatively-coupled domain controller, local domain information, the local domain information comprising a subset of information included in a directory service managed by the domain controller;

receiving, from a communicatively-coupled credential input interface, a physical access request comprising authentication credentials from a user;

identifying, based on the physical access request, physical access attribute information associated with a user entry included in the local domain information;

determining, based on the physical access attribute information, whether the authentication credentials are associated with a user entry having current access rights to the access-controlled area;

generating, based on the determination, an access control signal configured to implement an access control action by an access control device;

transmitting the access control signal to the access control device; and generating audited access information regarding access to the access-controlled area by the user.

6. The method of claim 5, wherein the method further comprises:

receiving, from the domain controller, local domain update information; and updating the local domain information based at least in part on the local domain update information.

7. The method of claim 5, wherein prior to receiving the local domain update information, the method further comprises:

transmitting, to the domain controller, a domain information update request.

8. The method of claim 7, wherein the domain information update request is transmitted periodically.

9. The method of claim 5, wherein the authentication credentials comprise at least one of a personal identification number, a password, a passphrase, a response to a challenge, a pattern, information stored on a card, information stored on a security token, information stored on a hardware token, information stored on a software token, and biometric identification information.

10. The method of claim 5, wherein the physical access attribute information comprises at least one credential issued to the user.

11. The method of claim 10, wherein the physical access attribute information further comprises at least one of a personal identification number, a password, a passphrase, a response to a challenge, a pattern, information stored on a card, information stored on a security token, information stored on a hardware token, information stored on a software token, and biometric identification information.

12. The method of claim 5, wherein determining whether the authentication credentials are associated with a user entry having current access rights to the access-controlled area comprises:

comparing the authentication credentials with the physical access attribute information; and determining that the received authentication credentials match the physical access attribute information.

13. The method of claim 5, wherein the access control signal is configured to cause the access control device to actuate a lock associated with the access-controlled area.

14. The method of claim 5, wherein the access control signal is configured to cause the access control device to change a status of an alarm system associated with the access-controlled are.

15. An access control system associated with an access-controlled area of a distributed site of an electric power delivery system, the system comprising:

a credential input interface configured to receive authentication credentials from a user;

a communications interface communicatively coupled to an access control device associated with the access-controlled area and a domain controller associated with the access control system, the domain controller managing a directory service comprising a plurality of user entries, each user entry comprising physical access attribute information;

a processor communicatively coupled to the credential input interface and the communications interface;

a computer-readable storage medium communicatively coupled to the processor, the computer-readable storage medium storing executable program instructions that cause the processor to:

transmit, via the communications interface to the domain controller, a request for a local domain update;

receive, via the communications interface from the domain controller, local domain update information, the local domain update information comprising at least a subset of the plurality of user entries included in the directory service managed by the domain controller;

store the local domain update information within local domain information managed by the access control system; and determine, based on the received authentication credentials and the local domain information, whether the authentication credentials are associated with a user entry having current access rights to the access-controlled area.

16. A method performed by an access control system associated with an access-controlled area of a distributed site of an electric power delivery system, the method comprising:

receiving, from a communicatively-coupled domain controller, local domain information, the local domain information comprising a subset of information included in a directory service managed by the domain controller;

receiving, from a communicatively-coupled credential input interface, a physical access request comprising authentication credentials from a user;

identifying, based on the physical access request, physical access attribute information associated with a user entry included in the local domain information;

determining, based on the physical access attribute information, whether the authentication credentials are associated with a user entry having current access rights to the access-controlled area;

generating, based on the determination, an access control signal configured to implement an access control action by an access control device;

transmitting the access control signal to the access control device;

generating, based on the determination, a logical access control signal configured to implement a logical access control determination by a resource included in the access-controlled area; and transmitting the logical access control signal to the resource.

17. A method performed by an access control system associated with an access-controlled area of a distributed site of an electric power delivery system, the method comprising:

transmitting, to a communicatively-coupled domain controller, a request for a local domain information;

receiving, from the communicatively-coupled domain controller, local domain information, the local domain information comprising a subset of information included in a directory service managed by the domain controller;

receiving, from a communicatively-coupled credential input interface, a physical access request comprising authentication credentials from a user;

identifying, based on the physical access request, physical access attribute information associated with a user entry included in the local domain information;

determining, based on the physical access attribute information, whether the authentication credentials are associated with a user entry having current access rights to the access-controlled area;

generating, based on the determination, an access control signal configured to implement an access control action by an access control device; and transmitting the access control signal to the access control device.

* * * * *